US005990729A

United States Patent [19]

Kozuka et al.

[11] Patent Number: 5,990,729

[45] Date of Patent: Nov. 23, 1999

[54] SEMICONDUCTOR INTEGRATED CIRCUIT HAVING FIRST AND SECOND VOLTAGE STEP DOWN CIRCUITS

[75] Inventors: Eiji Kozuka; Masaru Koyanagi, both of Yokohama, Japan

[73] Assignee: Kabushiki Kaisha Toshiba, Kawasaki, Japan

[21] Appl. No.: 08/959,774

[22] Filed: Oct. 29, 1997

[30] Foreign Application Priority Data

Dec. 5, 1996 [JP] Japan ..... 8-325267

[51] Int. Cl.[6] ..... G05F 3/02

[52] U.S. Cl. ..... 327/543; 327/538

[58] Field of Search ..... 327/427, 434, 327/538, 540, 541, 543; 323/312, 313

*Primary Examiner*—Terry D. Cunningham
*Attorney, Agent, or Firm*—Loeb & Loeb, LLP

[57] ABSTRACT

A semiconductor integrated circuit can precisely identify the level of an external input signal by stably supplying an internally stepped down voltage. It comprises a first N-channel MOS transistor having its drain/source connected between an external voltage supply node supplied with an external voltage and a first step-down output node for outputting a first stepped down voltage and its gate supplied with a control voltage higher than the external voltage, a first circuit supplied with the first stepped down voltage as operating voltage from the first step-down output node, a second N-channel MOS transistor having its drain/source connected between the external voltage supply node and a second step-down output node for outputting a second stepped down voltage and its gate supplied with the control voltage higher than the external voltage and having a drive capacity different from that of the first N-channel MOS transistor, the second step-down output node being separated from the first step-down output node and a second circuit supplied with the second stepped down voltage as operating voltage from the second step-down output node.

35 Claims, 7 Drawing Sheets

FIG. 1
(PRIOR ART)
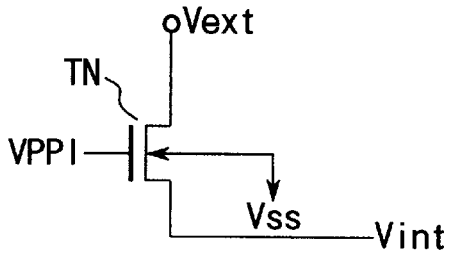
FIG. 2
(PRIOR ART)
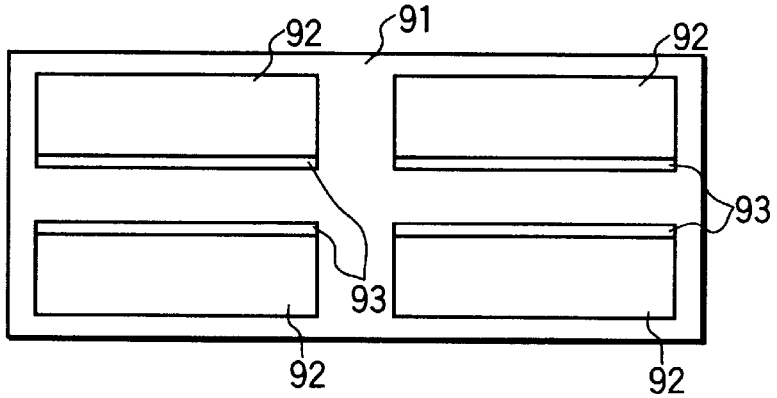
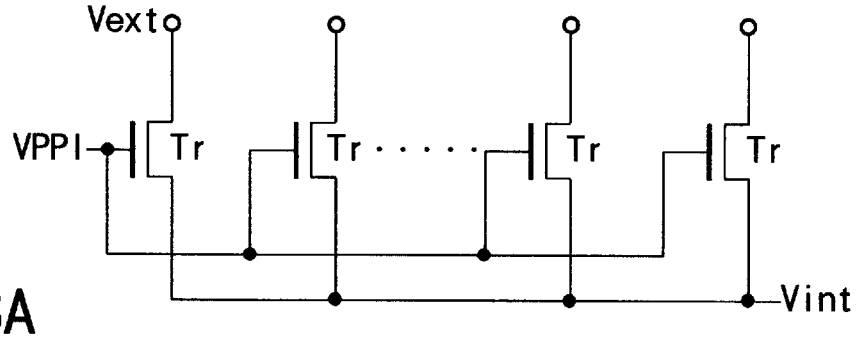
FIG. 3A
(PRIOR ART)
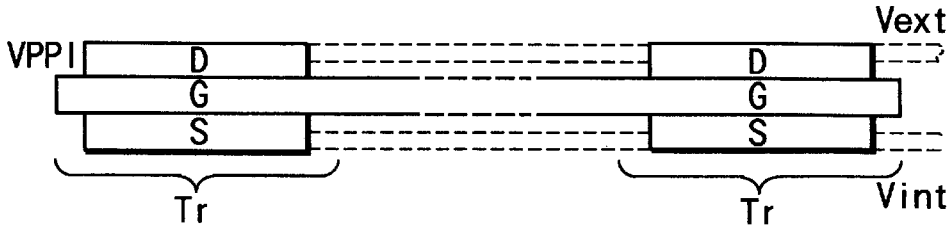
FIG. 3B
(PRIOR ART)

SEMICONDUCTOR INTEGRATED CIRCUIT HAVING FIRST AND SECOND VOLTAGE STEP DOWN CIRCUITS

BACKGROUND OF THE INVENTION

This invention relates to a semiconductor integrated circuit and, more particularly, it relates to a large scale integrated circuit (LSI) comprising an internal voltage generating circuit for generating an internal potential lower than an externally applied voltage within the semiconductor chip and using the internal voltage as operating voltage of the semiconductor chip. Such a semiconductor integrated circuit is suitably used for a dynamic random access memory (DRAM).

In the current tide of an ever increasing demand for more power saving LSIs, massive efforts are being paid for optimizing the dimensions and the logic of the circuit. In the field of DRAMs, there has been developed a technology of arranging a step-down circuit (a circuit for generating a voltage lower than an externally applied voltage by means of the externally applied voltage) on a semiconductor chip and using the output voltage of the step-down circuit as voltage for operating the semiconductor chip in order to reduce the charging/discharging current of the circuit and hence save the power consumption of the circuit. This technology has effectively been used for 16M DRAMs.

The use of a step-down circuit would not be necessary, if the semiconductor chip per se could be driven by a lower operating voltage supplied from an external voltage source. However, currently available technologies do not allow the use of a low externally applied voltage due to the system to which the semiconductor chip is applied, the components installed on the substrate of the semiconductor chip and other factors. The only possible way of reducing the power consumption rate of a semiconductor chip at present seems to be the use of a step-down circuit arranged within the chip.

FIG. 1 of the accompanying drawings is a schematic circuit diagram of a known step-down circuit.

Referring to FIG. 1, the step-down circuit comprises an N-channel MOS transistor (NMOS transistor) TN having its drain connected to an externally applied voltage Vext to step down the Vext and its gate connected to a stepped up potential VPPI for generating an stepped down internal potential, the voltage of the source of the transistor being used as stepped down potential Vint.

The voltage of the node connected to the gate of the NMOS transistor TN is stepped up for the following reasons.

(1) There occurs a fall of potential equal to a threshold value Vth due to the operating characteristic of the NMOS transistor TN and hence the gate voltage is stepped up to compensate the fall to make the Vint operable as internal voltage.

(2) When the semiconductor chip is activated, its internal circuit is electrically charged and then discharged to consequently lower the voltage level of Vint that is used as power source voltage of the chip and, therefore, the Vint has to be raised to an intended level because the circuit cannot operate properly with such a lowered level of Vint. Since the electric charge and discharge cycle of the internal circuit takes place as a result of a series of circuit operations, the fall in the voltage of Vint has to be compensated quickly and hence said gate voltage is stepped up for this compensation on the part of Vint.

A step-down circuit of the type under consideration is normally very large and has a circuit size (corresponding to the channel width of the NMOS transistor TN of the circuit) of several centimeters, although the size may vary depending on the power consumption level of the chip. The large step-down circuit is typically divided into several parts that are arranged within the semiconductor chip as shown in FIG. 2.

In FIG. 2, reference numeral 91 denotes a DRAM chip and reference numeral 92 denotes a memory cell array, whereas reference numeral 93 denotes a step-down circuit.

An NMOS transistor TN to be used in a step-down circuit as described above is normally also divided into unit NMOS transistors Tr having identical dimensions taking the possible gate delay into consideration, whose equivalent circuits and pattern layout are shown in FIGS. 3A and 3B respectively.

As shown in FIG. 4, an NMOS transistor TN to be used in a step-down circuit is not completely turned off when the voltage of the source rises to a certain level because it keeps on operating in a weak inversion zone to allow an electric current to flow therethrough and the source voltage Vint to gradually rise with time until Vint finally gets to the level of the drain voltage Vext (the rise in the Vint being indicated by DV in FIG. 4).

However, a DRAM chip can operate in any of several different modes where Vint dose not operates for a long period of time. Assume a mode of operation where external input signal /RAS has a long precharge time. The DRAM chip starts to become precharged when the signal /RAS moves from an active state (level "L") into an inactive state (level "H") and the precharging operation terminates after a certain period of time, when the operation of discharging the internal circuit of the DRAM also terminates.

Note that, however, the /RAS remains in the precharging conditions after the chip has been precharged to a necessary level if the precharging time is too long, although the chip does not operate according to the /RAS so that the Vint would not be subjected to charging and discharging and hence its voltage level rises.

FIG. 5 shows an external signal input circuit (e.g., a /RAS input buffer circuit) where problems can arise when the Vint rises above a preselected voltage.

FIG. 6A illustrates the relationship between the input voltage VIN and the output voltage VOUT (input/output characteristic) of the external signal input circuit of FIG. 5 when the operating voltage is equal to Vint and when it is equal to Vext.

The curves of the input/output characteristic of the input circuit has respective threshold values where the VOUT dramatically changes relative to the change in the value of VIN and the threshold value is shifted from a lower Vth1 to a higher Vth2 when the operating voltage of the input circuit is raised.

If the circuit threshold value is shifted from Vth1=0.7 V to Vth2=1.0 V, the following problem appears.

As the VIN is raised from 0 V with an operating voltage of the circuit equal to Vint, the VOUT shows a dramatic change at VIN=0.7 V and falls to 0 V at VIN=0.9 V. However, if the operating voltage is Vext, VOUT=Vext at VIN=0.7 and the VOUT is held to level "H" when the VIN is raised to 0.9 V. In other words, the level "H" of the input voltage is equal to 0.7 when the operating voltage is Vint, whereas the operating voltage does not exceed level "H" of the input voltage when the operating voltage is shifted to Vext and VIN=0.7 V so that the input voltage is judged to be at level "L" and the VOUT is not inverted (operational failure).

If the circuit is driven at a voltage higher than Vint, then the power consumption rate rises as a matter of course. Since all the circuits other than the external signal input circuit that are driven by Vint also consume power at an enhanced rate, the overall power consumption rate of the internal circuit would be enormous.

A technique of connecting a MOS transistor to a bleeder resistor is known from various existing documents including Japanese Patent Application KOKAI Publication No. 7-36557. However, it is a technique of connecting a resistor between the drain of a PMOS transistor to which the output voltage Vint of an internal step-down circuit is applied and a grounding node and hence not effective for suppressing the possible rise in the Vint.

BRIEF SUMMARY OF THE INVENTION

As described above, known step-down circuits of semiconductor integrated circuit comprising a step-down NMOS transistor are accompanied by the problem of an operational failure of the circuit using the source voltage of the NMOS transistor as power source voltage because it is not completely turned off when the source voltage is raised to a predetermined level and the source voltage gets drain voltage (external voltage) level only after a long period of time.

In view of the above problem, it is therefore the object of the present invention to provide a semiconductor integrated circuit that can secure the circuit operation by maintaining the internal operating voltage to an intended economic potential level and hence effectively suppress the power consumption rate if the circuit that uses the internal operating voltage has not been operated for a long period of time.

According to the invention, the above object is achieved by providing a semiconductor integrated circuit comprising:

- a first step-down circuit including a first N-channel MOS transistor having its drain/source connected between an external voltage supply node supplied with an external voltage and a first step-down output node for outputting a first stepped down voltage and its gate supplied with a control voltage higher than the external voltage;
- a first circuit supplied with the first stepped down voltage as operating voltage from the first step-down output node;
- a second step-down circuit including a second N-channel MOS transistor having its drain/source connected between the external voltage supply node and a second step-down output node for outputting a second stepped down voltage and its gate supplied with the control voltage higher than the external voltage and having a drive capacity different from that of the first N-channel MOS transistor, the second step-down output node being separated from the first step-down output node; and
- a second circuit supplied with the second stepped down voltage as operating voltage from the second step-down output node.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 1 is a circuit diagram of a known step-down circuit;

FIG. 2 is a schematic plan view of a step-down circuit on a known DRAM, showing how it is arranged;

FIGS. 3A and 3B are respectively a circuit diagram of an equivalent circuit of the NMOS transistor of the step-down circuit of FIG. 1 and a schematic plan view of the transistor, showing how it is arranged;

DETAILED DESCRIPTION OF THE INVENTION

Now, the present invention will be described by referring to the accompanying drawings that illustrate preferred embodiments of the invention.

Figure 7:
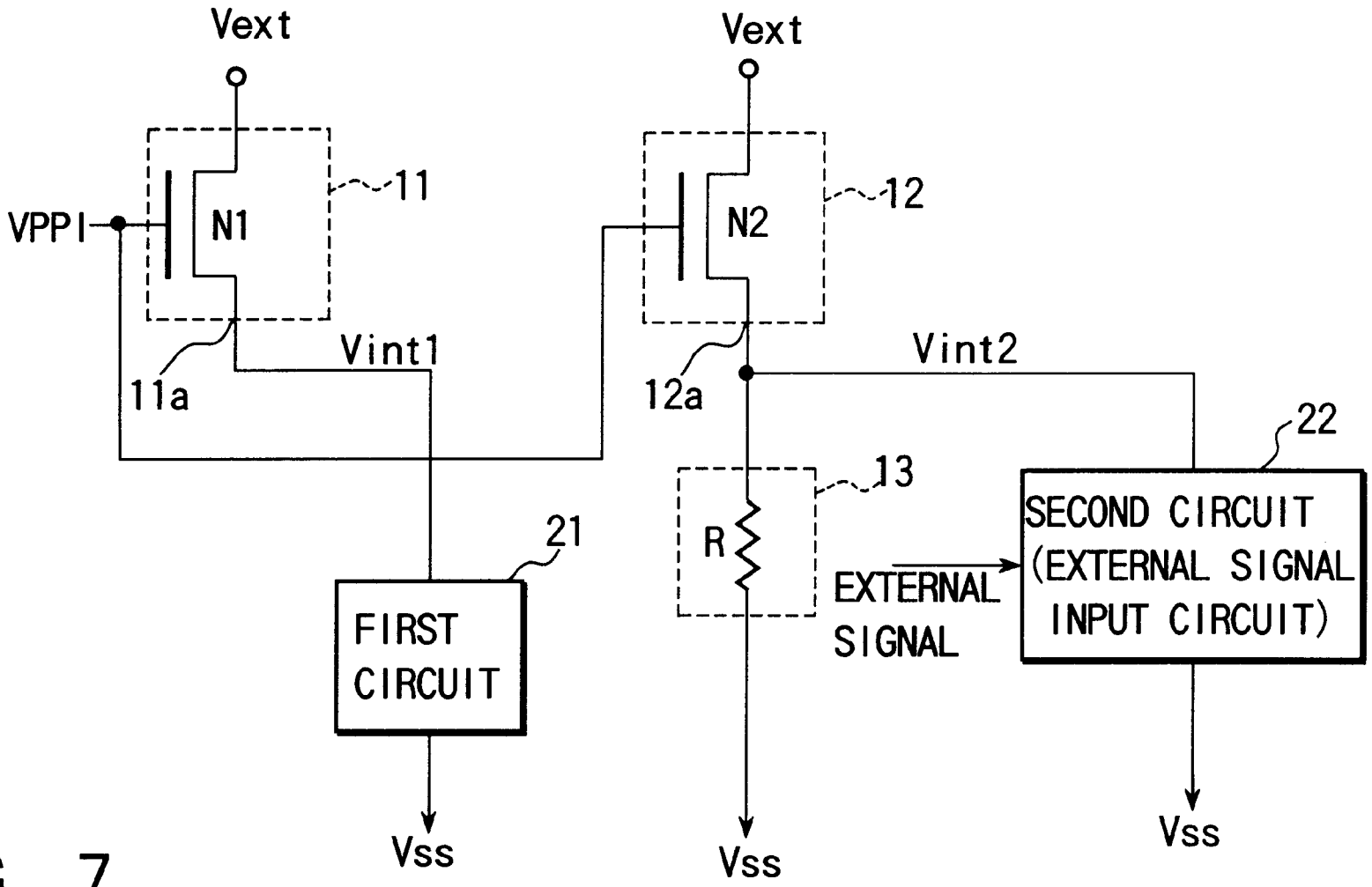
FIG. 7 is a circuit diagram of part of a first embodiment of semiconductor integrated circuit according to the invention.

FIG. 7 is a circuit diagram of part of a first embodiment of semiconductor integrated circuit according to the invention.

Referring to FIG. 7, it comprises a first step-down circuit 11 that includes a first NMOS transistor N1 having its drain/source connected between an external voltage supply node supplied with an external voltage Vext and a first step-down output node 11*a* for outputting a first stepped down voltage Vint1 lower than said external voltage and its gate supplied with a control voltage VPPI higher than said external voltage. Said control voltage VPPI is a voltage held to a constant level when the power supply of the integrated circuit chip is turned on.

The semiconductor integrated circuit also comprises a second step-down circuit 12 that includes a second NMOS transistor N2 having its drain/source connected between said external voltage supply node supplied with said external voltage and a second step-down output node 12*a* for outputting a second stepped down voltage Vint2 lower than said external voltage and its gate supplied with said control voltage VPPI, said second NMOS transistor N2 having a drive capacity different from said first NMOS transistor N1. Note that said second step-down output node 12*a* is separated from said first step-down output node 11*a*.

The semiconductor integrated circuit further comprises a first circuit 21 supplied with said first stepped down voltage Vint1 as operating voltage from said first step-down output node 11*a*. Said first circuit 21 may typically include most of the internal circuits of the integrated circuit.

The semiconductor integrated circuit further comprises a second circuit 22 supplied with said second stepped down voltage Vint2 as operating voltage from said second step-down output node 12*a*. Said second circuit 22 includes an external signal input circuit.

A current leak circuit 13 is connected between the second step-down output node 12*a* of the second step-down circuit 12 and the ground potential node in order to prevent the potential of the second step-down output node 12*a* from being raised by a prolonged charging operation.

Note that the second NMOS transistor N2 of the second step-down circuit 12 is dimensionally smaller than the first NMOS transistor N1 of the first step-down circuit 11.

More specifically, the first NMOS transistor N1 and the second NMOS transistor N2 are dimensionally proportional to the power consumption rates of the respective transistors. Empirically, they are dimensionally differentiated by the magnitude of ten times and N1>>N2 is expected.

Figure 8A:
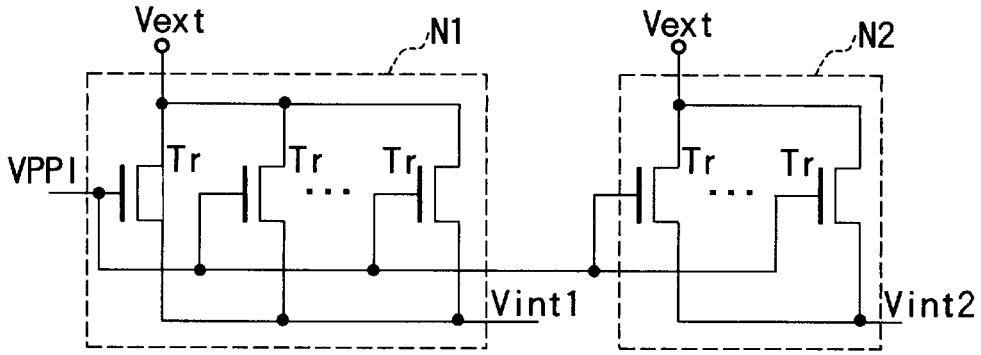
FIGS. 8A, 8B and 8C are an equivalent circuit of the NMOS transistors N1 and N2 of the step-down circuit of FIG. 7 and schematic plan views of the transistors, showing how they are arranged respectively.
Figure 8B:
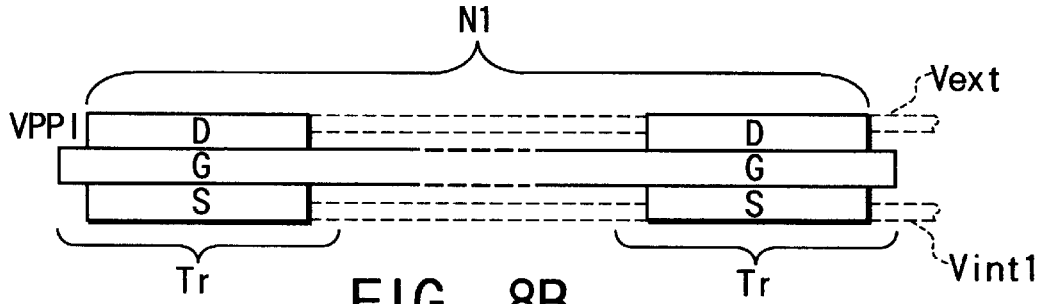
Figure 8C:
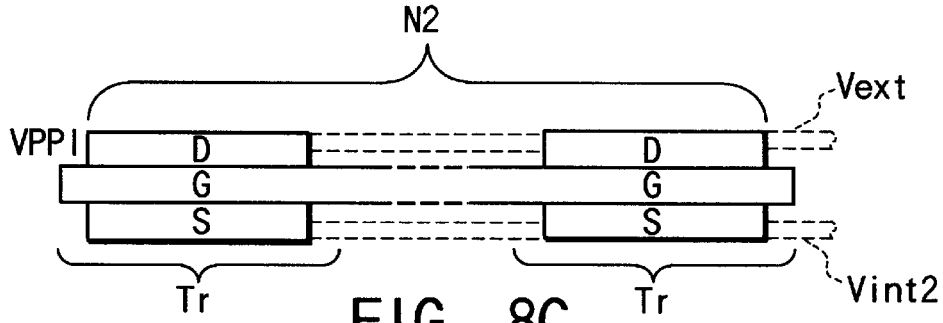
Figure 9:
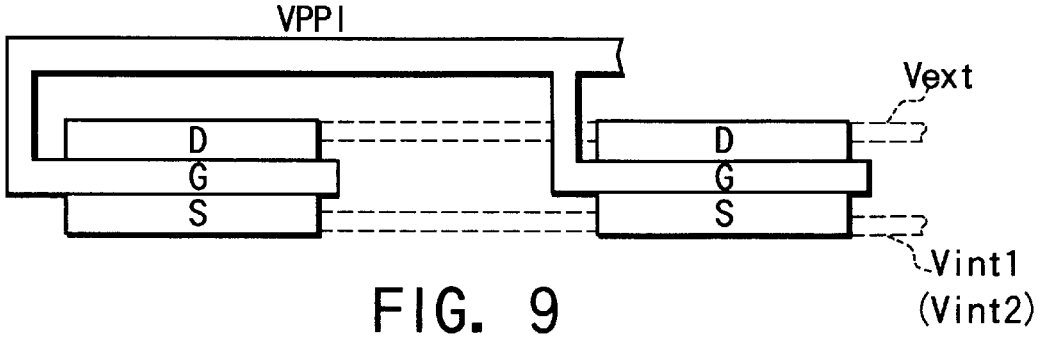
FIG. 9 is a schematic plan view of an NMOS transistor obtained by modifying the NMOS transistors N1 and N2 of the step-down circuit of FIG. 7.

FIGS. 8A, 8B and 8C are an equivalent circuit of the NMOS transistors N1 and N2 of the step-down circuit of FIG. 7 and schematic plan views of the transistors, showing how they are arranged respectively. FIG. 9 is a schematic plan view of an NMOS transistor obtained by modifying the NMOS transistors N1 and N2 of the step-down circuit of FIG. 7.

Referring to FIGS. 8A, 8B and 8C, each of said first NMOS transistor N1 and said second NMOS transistor N2 is divided into several unit NMOS transistors Tr that are separated from each other by way of a device separating zone. Note that D denotes a drain region, S denotes a source region and G denotes a gate wire in FIGS. 8B and 8C.

As shown in FIGS. 8B and 8C, the gate wires G of the unit NMOS transistors Tr may be arranged in the form of a single straight wire connecting the channel regions of the transistors Tr and arranged above them. Alternatively, they may be formed independently on the respective channel regions of the unit NMOS transistors Tr and then connected to a common wire by way of respective lead wires as shown in FIG. 9. Desirably, the unit NMOS transistors Tr are made to have same dimensions in order to make the first step-down circuit 11 and the second step-down circuit 12 perform identically for stepping down operation (and hence make the first stepped down voltage Vint1 equal to the second stepped down voltage Vint2) regardless of possible variations in the manufacturing process.

Said current leak circuit 13 is added to prevent the output voltage of the second step-down circuit 12 from rising from the intended voltage Vint2 toward the external voltage Vext. FIG. 7 illustrates the most simple circuit configuration that can be used for the current leak circuit, where a resistor R is connected between the second step-down output node 12*a* and the ground potential node.

Figure 10:
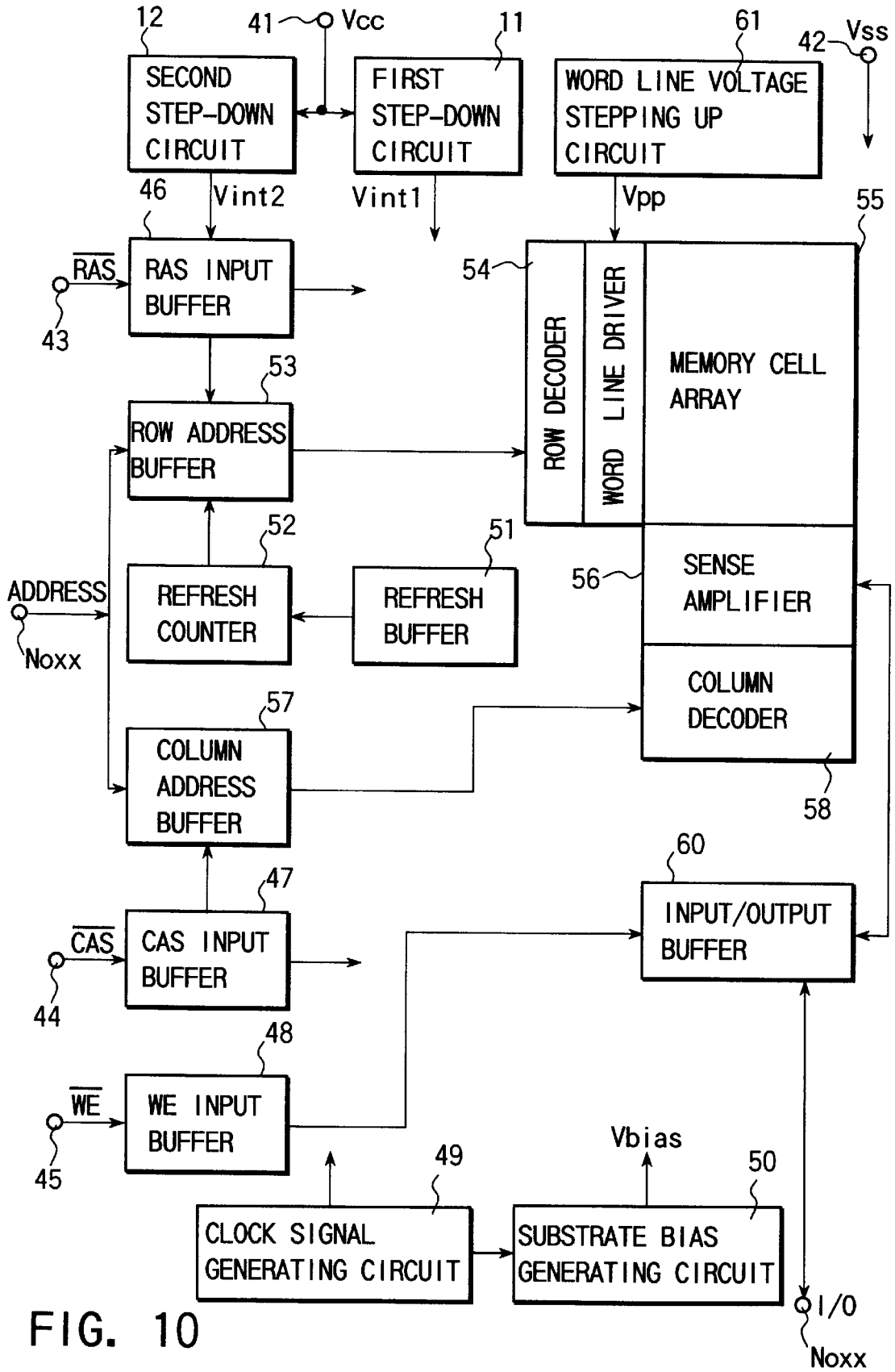
FIG. 10 is a schematic block diagram of a DRAM realized by using the first embodiment of semiconductor integrated circuit of FIG. 7 and comprising a first step-down circuit, a second step-down circuit, a first circuit and a second circuit.

FIG. 10 is a schematic block diagram of a DRAM realized by using the first embodiment of semiconductor integrated circuit of FIG. 7 and comprising a first step-down circuit, a second step-down circuit, a first circuit and a second circuit.

Referring to FIG. 10, it comprises a power supply terminal 41 to which power supply voltage VCC is externally applied, a grounding terminal 42 having the grounding potential VSS, an RAS terminal 43 for receiving a /RAS (Row Address Strobe) signal from outside, a CAS terminal 44 for receiving a /CAS (Column Address Strobe) signal from outside and a WE terminal for receiving a /WE (Write Enable) signal also from outside.

The circuit of FIG. 10 additionally comprises an RAS input buffer 46 for receiving a /RAS signal from said RAS terminal, a CAS input buffer 47 for receiving a /CAS signal from said CAS terminal, a WE input buffer 48 for receiving a /WE signal from said WE terminal, a clock signal generating circuit 49 for generating an internal clock signal in synchronism with an externally applied clock signal and a substrate bias generating circuit 50 for supplying a bias voltage Vbias to the semiconductor substrate of the DRAM chip by using said internal clock signal.

The circuit of FIG. 10 further comprises a refresh control circuit 51 for controlling the refresh operation of the memory cell array of the DRAM, a refresh counter 52 for generating a refresh address signal, a row address buffer 53 for receiving either the row address signal of an address input signal or the output of said refresh counter 52, a row decoder 54 for decoding the output of said row address buffer 53, a memory cell array 55, one of the rows of which is selected by the output of said row decoder 54, and a sense amplifier 56 for detecting the read potential of said memory cell array 55.

The circuit of FIG. 10 further comprises a column address buffer 57 for receiving the column address signal of an address input signal, a column decoder 58 for decoding the output of side column address buffer 57, a column selection circuit controlled by the output of said column decoder 58 and an input/output buffer 60 for carrying out a data input/output operation.

Reference numeral 11 in FIG. 10 denotes a first step-down circuit that is supplied with the power supply voltage VCC (corresponding to said external voltage Vext) coming from said power supply terminal 1, which voltage may typically be 5 V, and produces a first stepped down voltage (a first internal supply voltage) Vint1, which voltage may typically be 3.3 V, by stepping down the power supply voltage VCC.

Reference numeral 12 in FIG. 10 denotes a second step-down circuit that is supplied with the power supply voltage VCC (corresponding to said external voltage Vext) and produces a second stepped down voltage (a second internal supply voltage) Vint2, which voltage may typically be 3.3 V, by stepping down the power supply voltage VCC.

Reference numeral 61 in FIG. 10 denotes a word line step-up circuit for stepping up the first internal supply voltage Vint1 coming from said first step-down circuit 11 and supplying it to a word line driver circuit of said row decoder 54 as word line drive voltage source Vpp.

In the present embodiment, the second internal power-supply voltage Vint2 is applied as operating voltage of the RAS input buffer 46. The RAS input buffer 46 receives an input signal, i.e., /RAS, directly from a device provided outside the chip. The RAS input buffer corresponds to the second circuit 22 shown in FIG. 2.

It will be described why the second internal power-supply voltage Vint2 is applied to the RAS input buffer 46 and the word-line driver circuit. As described above, the RAS input buffer 46 and the word-line driver circuit may have their threshold values changed by their operating voltages and may malfunction. To avoid malfunctioning of the buffer 46 and the driver circuit from malfunctioning, a resistor R is used as shown in FIG. 7. The resistor R prevents the voltage Vint2 from rising, thereby stabilizing the same. The voltage Vint2 thus stabilized is applied to the buffer 46 and the driver circuit, which would not malfunction at all. The voltage Vint1 may be applied to other circuits which do not malfunction even if their threshold values change.

Also note that, in this embodiment, said first internal supply voltage Vint1 is supplied as the operating voltage of predetermined circuits of the DRAM except said RAS input buffer 46 and said word line driver circuit, which predetermined circuits correspond to the first circuit 21 of FIG. 7.

The power supply voltage VCC may be supplied without alteration as the operating voltage of the output buffer portion of said input/output buffer 60.

Now, the operation of the circuit of FIG. 7 will be described by referring to that of the DRAM of FIG. 10.

For example, in a mode where /RAS is alternately repeating a predetermined active cycle and a predetermined precharge cycle (as external input signals are switched repeatedly), the second circuit 22 to which Vint2 is supplied as operating voltage is electrically charged and discharged so that Vint2 would not be raised close to Vext.

To the contrary, in a mode where /RAS has a long precharge time tRP (and hence Vint2 is not activated for a long time), Vint2 is not discharged from the second circuit 22 to which Vint2 is supplied as operating voltage but from the resistor R because the circuit does not follow /RAS for its operation.

Then, Vint2 would not be raised if it is so produced as to show a desired voltage level that is defined by the ratio of the resistance of the NMOS transistor N2 and the resistor R.

Since the resistance of the resistor R depends on the dimensions of the NMOS transistor N2, the selected value of Vint2 and other factors and an electric current is constantly flowing therethrough, the second circuit 22 driven by Vint2 has to be dimensionally minimized.

Figure 11:
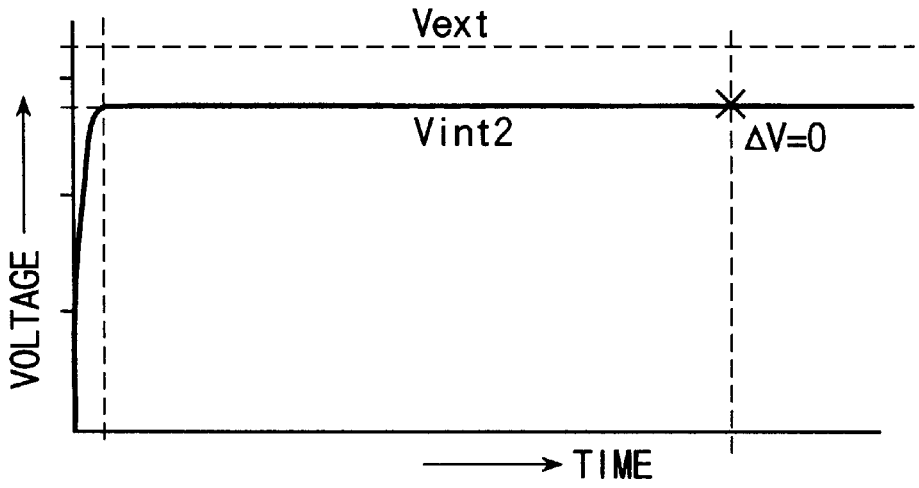
FIG. 11 is a graph showing the change with time of the output voltage Vint of the step-down circuit of FIG. 7.

FIG. 11 is a graph showing the change with time of the output voltage Vint2 of the step-down circuit of FIG. 7.

Figure 4:
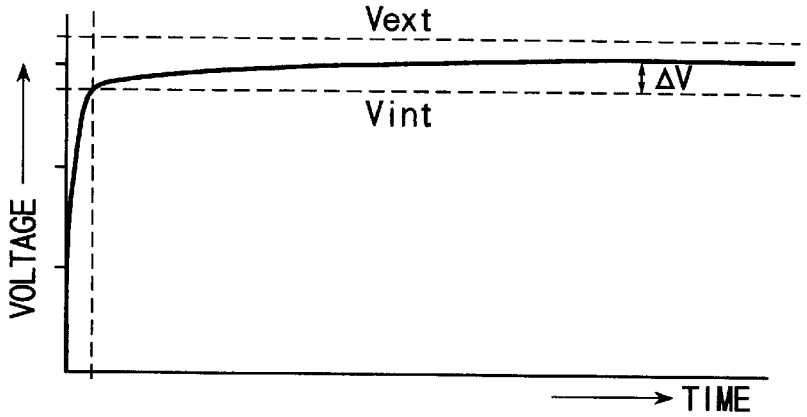
FIG. 4 (PRIOR ART)
FIG. 4 is a graph showing the change with time of the output voltage Vint of the step-down circuit of FIG. 1.
Figure 5:
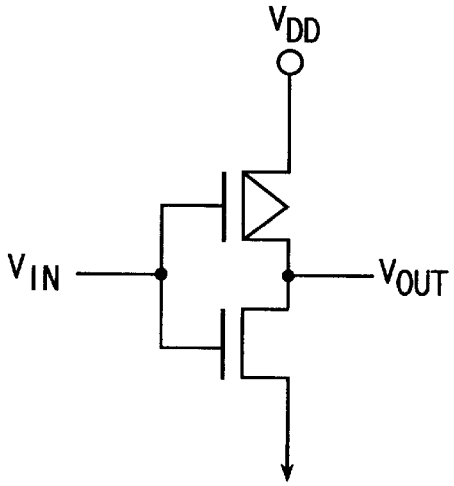
FIG. 5 (PRIOR ART)
FIG. 5 is a circuit diagram of the schematic circuit of the inverter of a known external signal input circuit that is accompanied by a problem.
Figure 6A:
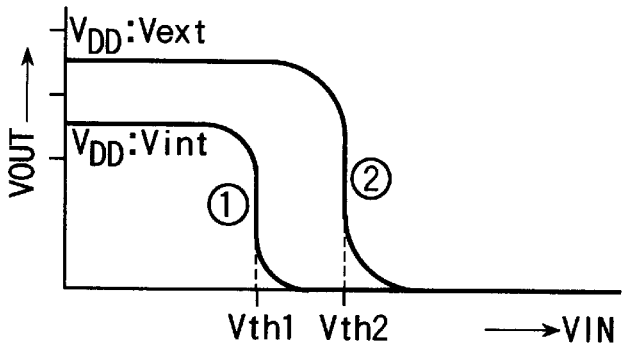
FIG. 6A (PRIOR ART)
FIGS. 6A and 6B are graphs showing respectively the operating voltage dependency of the circuit threshold value and that of the power consumption rate of the circuit of FIG. 5.
Figure 6B:
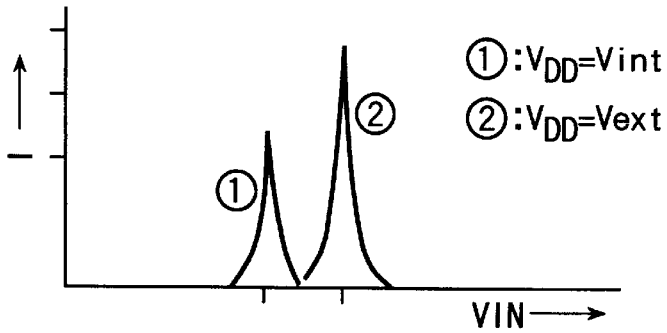
FIG. 6B (PRIOR ART)

Referring to FIG. 11, the time required for Vint2 to get to a desired voltage level is slightly longer than that of the known circuit of FIG. 4, the extended time does not provide any practical problem because it corresponds to the operation when the semiconductor chip becomes energized by the power supply. In other words, the rise D in the voltage level of Vint2 is equal to 0 if the chip is not driven for a long period of time.

Thus, according to the above embodiment, in a DRAM comprising a step-down circuit that produces a voltage lower than the external voltage applied externally to the semiconductor substrate so that the output voltage of said step-down circuit is used as the operating voltage of the integrated circuit, the step-down circuit is realized in the form of a pair of separate step-down circuits 11 and 12 that supply respective stepped down voltages Vint1 and Vint2 to different targets, said stepped down voltages Vint1 and Vint2 being completely independent from each other.

More specifically, said pair of step-down circuits are a first step-down circuit 11 serving for a first circuit 21 and a second step-down circuit 12 exclusively serving for a second circuit 22 (external signal input circuit), wherein the drive capacity of said second step-down circuit 12 is held lower than that of said first step-down circuit 11 and a resistor R is connected between the output node of said second step-down circuit 12 and the VSS node in order to stabilize the intended stepped down voltage.

If the single step-down circuit of a DRAM is replaced by a pair of step-down circuits according to the invention and the sum of the drive capacities of the pair of step-down circuits is made equal to the drive capacity of a single step-down circuit, the first step-down circuit 11 can be down-sized because its drive capacity is smaller than that of the single step-down circuit.

Said current leak circuit 13 comprising a resistor R may be replaced by any circuit that can effectively control the current leak in terms of external signal input of the external signal input circuit. A conceivable replacement of the current leak circuit 13 will be described below.

Figure 12:
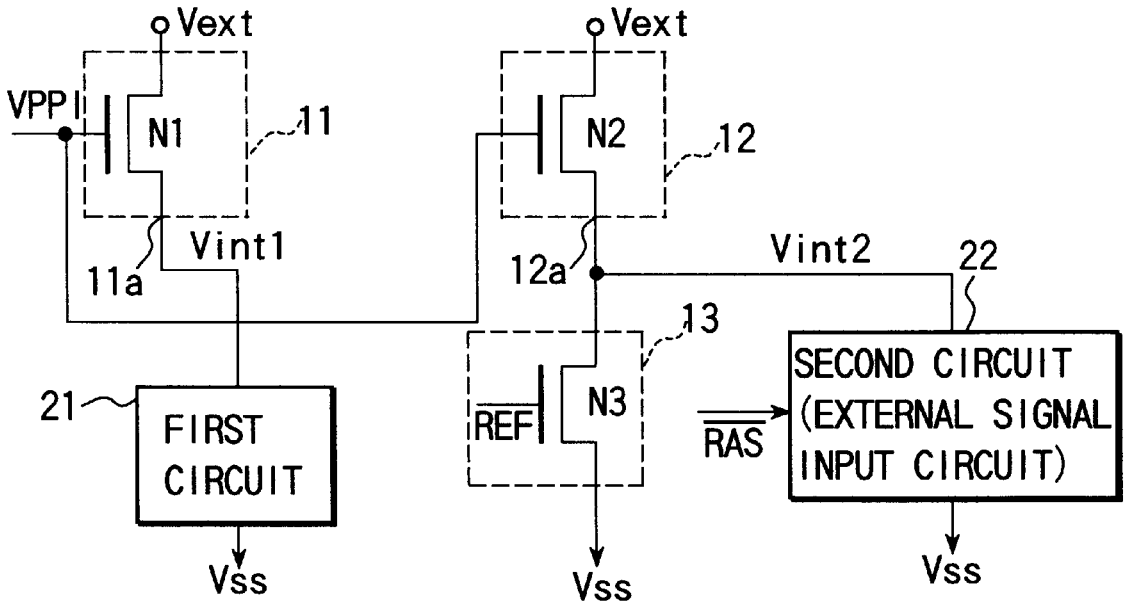
FIG. 12 is a circuit diagram of a second embodiment of step-down circuit of a DRAM according to the invention.
Figure 13:
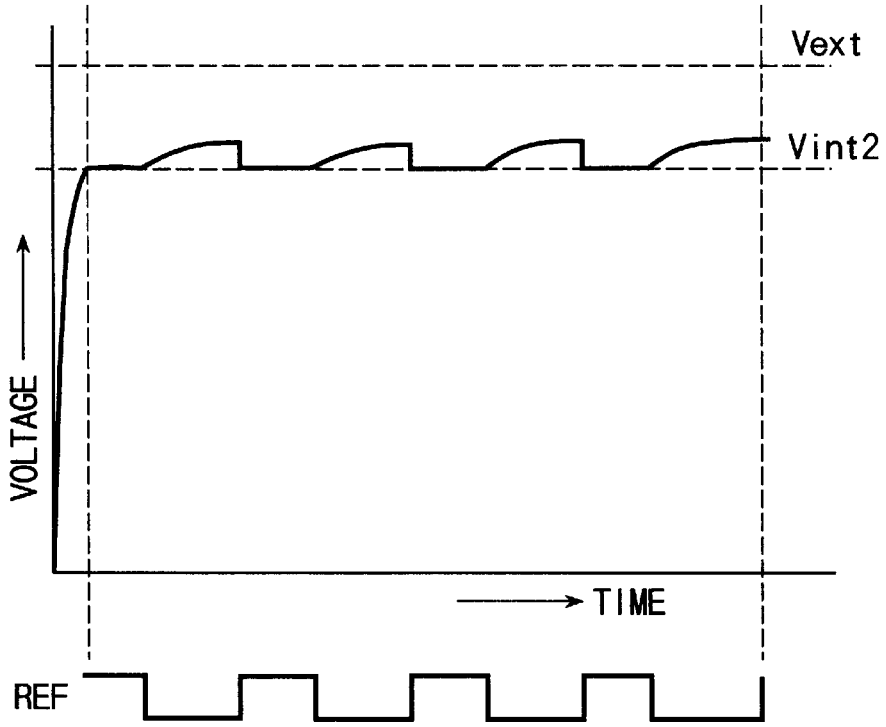
FIG. 13 is a graph showing the change with time of the output voltage Vint of the step-down circuit of FIG. 12.

FIG. 12 is a circuit diagram of a second embodiment of step-down circuit of a DRAM according to the invention and FIG. 13 is a graph showing the change with time of the output voltage Vint of the step-down circuit of FIG. 12.

Referring to FIG. 12, the step-down circuit shown there is realized by replacing the resistor R of the current leak circuit 13 of the first embodiment of FIG. 7 with a third NMOS transistor N3 having its drain/source connected between the second step-down output node and the ground potential and its gate connected to a control signal supply source. Otherwise, the step-down circuit is same as that of the first embodiment and hence its components are denoted respectively by the same reference symbols as those of FIG. 7.

The control signal applied to the gate of said third NMOS transistor N3 is a clock signal whose supply is controlled as a function of the external signal input of said external signal input circuit. An example of such a clock signal is a self-refresh type signal (e.g., self-refresh signal REF) that controls the self-refresh operation of the DRAM as a function of /RAS.

A DRAM that can operate in a self-refresh mode carries out a self-refresh operation under the control of a timer circuit (not shown) which is a built-in circuit of the chip in order to secure the data stored in the memory cells when the precharge time of /RAS becomes longer than a predetermined time (and hence the chip does not operate for more than the predetermined time). Then, a self-refresh signal REF is automatically generated to control the self-refresh operation. The generated self-refresh signal REF is a clock signal having a constant period that is longer than three to four times of the shortest cycle of /RAS.

Therefore, in a mode where the precharge time of /RAS is longer than a predetermined time period, while the DRAM does not follow /RAS for its operation and Vint2 is not discharged from the external signal input circuit to which Vint2 is supplied as operating voltage, the third NMOS transistor N3 is turned on and off cyclically with a predetermined period to discharge Vint2 cyclically to prevent Vint2 from being raised close to Vext.

Alternatively, the control signal applied to the gate of said third NMOS transistor N3 may be a clock signal having a constant period that is not synchronized with that of the external signal input of said external signal input circuit. An example of such a control signal is a clock signal obtained by dividing the frequency of the clock signal used in the substrate bias generating circuit 50 for supplying a bias voltage Vbias to the semiconductor substrate of the DRAM.

Said current leak circuit 13 comprising a resistor R may alternatively be replaced by a plurality of circuits having respective current leak characteristics that are different from each other and inserted between the second step-down output node 12*a* and the ground potential in such a way that the plurality of current paths are controlled independently according to the mode where the LSI is driven. A conceivable alternative replacement of the current leak circuit 13 will be described below.

Figure 14:
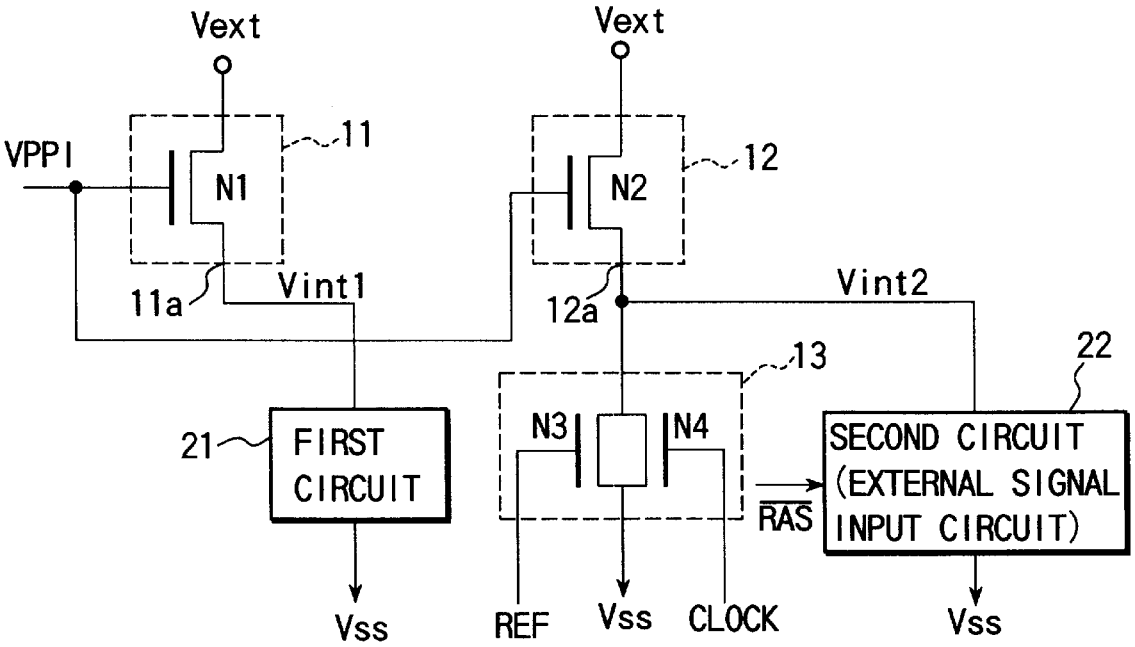
FIG. 14 is a circuit diagram of a third embodiment of step-down circuit of a DRAM according to the invention.

FIG. 14 is a circuit diagram of a third embodiment of step-down circuit of a DRAM according to the invention. Referring to FIG. 14, the step-down circuit shown there is realized by replacing the current leak circuit of the second embodiment of FIG. 12 with a third NMOS transistor N3 having its drain/source connected between the second step-down output node 12*a* and the ground potential and its gate connected to a first control signal supply source and a fourth NMOS transistor N4 having its drain/source connected between the second step-down output node 12*a* and the ground potential and its gate connected to a second concontrol signal source. Otherwise, the step-down circuit is same as that of the second embodiment and hence its components are denoted respectively by the same reference symbols as those of FIG. 12.

In this embodiment of DRAM, the third NMOS transistor N3 or the fourth NMOS transistor N4 may be alternatively driven as a function of /RAS by supplying a clock signal either as the first control signal or the second control signal as a function of /RAS.

More specifically, if the embodiment of DRAM can be operated either in a first mode where the precharge time of /RAS is longer than a predetermined time period or in a second mode where the active time of /RAS is longer than a predetermined time period, it may be so arranged that a self-refresh signal REF is supplied only to the gate of the third NMOS transistor N3 out of the pair of NMOS transistors of the current leak circuit 13 in the first mode and a clock signal obtained by dividing the frequency of the clock signal for the substrate bias generating circuit in the second mode.

If such is the case, a desired current leak effect (or the effect of suppressing the rise of Vint2) can be achieved in either of the two different modes by differentiating the third NMOS transistor N3 and the fourth NMOS transistor N4 dimensionally from each other or the period of the self-refresh signal REF and that of the frequency divided clock signal of the clock signal for the substrate bias generating circuit from each other appropriately.

As described in detail, the present invention provide a semiconductor integrated circuit that can precisely identify the level of an external input signal by stably supplying an internally stepped down voltage.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A semiconductor integrated circuit comprising:

a first step-down circuit including a first N-channel MOS transistor having its drain/source connected between a voltage supply node supplied with a voltage and a first step-down output node for outputting a first stepped down voltage and its gate supplied with a control voltage;

a first circuit supplied with said first stepped down voltage as operating voltage from said first step-down output node;

a second step-down circuit including a second N-channel MOS transistor having its drain/source connected between said voltage supply node and second step-down output node for outputting a second stepped down voltage and its gate supplied with said control voltage;

a second circuit supplied with said second stepped down voltage as operating voltage from said second step-down output node; and a current leak circuit provided between said second step-down output node and a ground potential, wherein said second circuit includes an external signal input circuit for receiving a signal from an outside of the semiconductor integrated circuit, and said first circuit includes circuits other than said external signal input circuit.

2. The semiconductor integrated circuit according to claim 1, wherein an external voltage is supplied to said voltage supply node.

3. The semiconductor integrated circuit according to claim 1, wherein said second N-channel MOS transistor has a drive capacity different from that of said first N-channel MOS transistor.

4. The semiconductor integrated circuit according to claim 1, wherein said second N-channel MOS transistor is dimensionally smaller than said first N-channel MOS transistor.

5. The semiconductor integrated circuit according to claim 2, wherein said control voltage is higher than said external voltage.

6. The semiconductor integrated circuit according to claim 1, wherein each of said first N-channel MOS transistor and said second N-channel MOS transistor is composed of a plurality of unit transistors electrically connected in parallel with each other and having identical dimensions.

7. The semiconductor integrated circuit according to claim 1, wherein the current leak rate of said current leak circuit is controlled as a function of the external signal input of said external signal input circuit.

8. The semiconductor integrated circuit according to claim 7, wherein said current leak circuit comprises a third N-channel MOS transistor having its drain/source connected between said second step-down output node and the ground potential and its gate supplied with a control signal.

9. The semiconductor integrated circuit according to claim 8, wherein said control signal is a clock signal supplied as a function of the external signal input of said external signal input circuit.

10. The semiconductor integrated circuit according to claim 8, wherein said control signal is a clock signal having a constant period asynchronous with that of the external signal input of said external signal input circuit.

11. The semiconductor integrated circuit according to claim 10, wherein said clock signal is a signal obtained by frequency-dividing a clock signal used in a substrate bias generating circuit for producing a substrate bias voltage of the semiconductor integrated circuit.

12. The semiconductor integrated circuit according to claim 1, wherein said current leak circuit comprises a resistor connected between said second step-down circuit and the ground potential.

13. The semiconductor integrated circuit according to claim 1, wherein said current leak circuit has a plurality of current paths formed between said second step-down output node and the ground potential and having different respective current leak characteristics.

14. The semiconductor integrated circuit according to claim 13, wherein said current leak circuit comprises a third N-channel MOS transistor having its drain/source connected between said second step-down circuit and the ground potential and its gate driven by a first control signal and a fourth N-channel MOS transistor having its drain/source connected between said second step-down output node and the ground potential and its gate controlled by a second control signal.

15. The semiconductor integrated circuit according to claim 14, wherein said second circuit is an external signal input circuit for receiving a signal from an outside of the semiconductor integrated circuit and said first control signal and said second control signal are clock signals, at least one of said first control signal and said second control signal being inputted to said current leak circuit so as to operate said current leak circuit intermittently.

16. A semiconductor integrated circuit comprising:

a first step-down circuit supplied with a voltage of a first voltage node to output a first stepped down voltage lower than the voltage of said first voltage node;

a first circuit connected to an output node of said first step-down circuit;

a second step-down circuit supplied with a voltage of a second voltage node to output a second stepped down voltage lower than the voltage of said second voltage node;

a second circuit connected to said second step-down circuit; and a current leak circuit provided between said output node of said second step-down circuit and a ground potential, wherein said second circuit includes an external signal input circuit for receiving a signal from an outside of the semiconductor integrated circuit, and said first circuit includes circuits other than said external signal input circuit.

17. The semiconductor integrated circuit according to claim 16, wherein said second step-down circuit has a current output capacity different from that of said first step-down circuit.

18. A semiconductor integrated circuit with a built-in dynamic type random access memory, said semiconductor integrated circuit comprising:

a first step-down circuit including a first N-channel MOS transistor having its drain/source connected between a voltage supply node supplied with a voltage and a first step-down output node for outputting a first stepped down voltage and its gate supplied with a control voltage;

a first circuit supplied with said first stepped down voltage as operating voltage from said first step-down output node and included in said dynamic type random access memory;

a second step-down circuit including a second N-channel MOS transistor having its drain/source connected between said voltage supply node and a second step-down output node for outputting a second stepped down voltage and its gate supplied with said control voltage;

a second circuit supplied with said second stepped down voltage a operating voltage from said second step-down output node and included in a dynamic type random access memory, said second circuit including an RAS input buffer for receiving a row address strobe signal RAS, a CAS input buffer for receiving a column address strobe signal CAS, a row and a column address signal buffer and write enable signal input buffer; and a current leak circuit provided between said second step down output node and a ground potential.

19. The semiconductor integrated circuit according to claim 18, wherein said control voltage is higher than said voltage.

20. The semiconductor integrated circuit according to claim 18, wherein said second N-channel MOS transistor has a drive capacity different from that of said first N-channel MOS transistor.

21. The semiconductor integrated circuit according to claim 18, wherein said second step-down circuit has a drive capacity lower than that of said first step-down circuit.

22. The semiconductor integrated circuit according to claim 18, wherein said second N-channel MOS transistor is dimensionally smaller than said first N-channel MOS transistor.

23. The semiconductor integrated circuit according to claim 18, wherein each of said first N-channel MOS transistor and said second N-channel MOS transistor is composed of a plurality of unit transistors electrically connected in parallel with each other and having identical dimensions.

24. The semiconductor integrated circuit according to claim 18, the current leak rate of said current leak circuit is controlled as a function of the input signal of said RAS input buffer.

25. The semiconductor integrated circuit according to claim 24, wherein said current leak circuit comprises a third N-channel MOS transistor having its drain/source connected between said second step-down output node and the ground potential and its gate supplied with a control signal.

26. The semiconductor integrated circuit according to claim 25, wherein said control signal is a clock signal supplied as a function of the input signal of said RAS input buffer.

27. The semiconductor integrated circuit according to claim 26, wherein said control signal is a refresh type signal.

28. The semiconductor integrated circuit according to claim 25, wherein said control signal is a clock signal having a constant period asynchronous with that of said input signal of said RAS input buffer.

29. The semiconductor integrated circuit according to claim 28, wherein said clock signal is a signal obtained by frequency-dividing a clock signal used in a substrate bias generating circuit for producing a substrate bias voltage of the semiconductor integrated circuit.

30. The semiconductor integrated circuit according to claim 18, wherein said second circuit is an RAS input buffer for receiving a row address strobe signal RAS and said current leak circuit comprises a resistor connected between said second step-down output node and the ground potential.

31. The semiconductor integrated circuit according to claim 18, wherein said current leak circuit has a plurality of current paths formed between said second step-down output node and the ground potential and having different respective current leak characteristics.

32. The semiconductor integrated circuit according to claim 31, wherein said current leak circuit comprises a third N-channel MOS transistor having its drain/source connected between said second step-down output node and the ground potential and its gate driven by a first control signal and a fourth N-channel MOS transistor having its drain/source connected between said second step-down output node and the ground potential and its gate controlled by a second control signal.

33. The semiconductor integrated circuit according to claim 32, wherein said first control signal and said second control signal are clock signals, at least one of said first control signal and said second control signal being inputted to said current leak circuit so as to operate said current leak circuit intermittently.

34. The semiconductor integrated circuit according to claim 33, wherein said first control signal is a refresh type signal and said second control signal is one of clock signals supplied alternatively as a function of the input signal of said RAS input buffer.

35. A semiconductor integrated circuit with a built-in dynamic type random access memory, said semiconductor integrated circuit comprising:

a first step-down circuit supplied with a supply voltage to output a first stepped down voltage lower than said supply voltage;

a first circuit supplied with an operating voltage from said first step-down circuit and arranged in said dynamic type random access memory;

a second step-down circuit supplied with said supply voltage to output a second stepped down voltage lower than said supply voltage;

a second circuit supplied with an operating voltage from said second step-down circuit and included in said dynamic type random access memory, said second circuit including an RAS input buffer for receiving a row address strobe signal RAS, a CAS input buffer for receiving a column address strobe signal CAS, a row and a column address signal buffer and write enable signal input buffer; and a current leak circuit provided between said second step down output node and a ground potential.

* * * * *